US008544131B2

(12) United States Patent
Braun et al.

(10) Patent No.: US 8,544,131 B2
(45) Date of Patent: Oct. 1, 2013

(54) PRESSURE INDICATOR FOR AN ORAL CARE INSTRUMENT

(75) Inventors: Philip Maurice Braun, Exeter, RI (US); Karen Lynn ClaireZimmet, Waltham, MA (US); Alexander Timothy Chenvainu, Sudbury, MA (US); Alexander Hilscher, Oberursel (DE)

(73) Assignee: The Gillette Company, Boston, MA (US)

( * ) Notice: Subject to any disclaimer, the term of this patent is extended or adjusted under 35 U.S.C. 154(b) by 512 days.

(21) Appl. No.: 12/822,624

(22) Filed: Jun. 24, 2010

(65) Prior Publication Data

US 2010/0325828 A1 Dec. 30, 2010

Related U.S. Application Data

(60) Provisional application No. 61/220,623, filed on Jun. 26, 2009.

(51) Int. Cl.
*A46B 13/02* (2006.01)

(52) U.S. Cl.
USPC ..... 15/22.1; 15/105

(58) Field of Classification Search
USPC ..... 15/22.1, 167.1, 105
See application file for complete search history.

(56) References Cited

U.S. PATENT DOCUMENTS

| | | | | |
|---|---|---|---|---|
| 2,319,205 | A | | 5/1943 | Buck |
| 3,512,202 | A | | 5/1970 | Taylor |
| 4,192,035 | A | | 3/1980 | Kuris |
| 4,253,212 | A | | 3/1981 | Fujita |
| 4,340,069 | A | | 7/1982 | Yeaple |
| 4,450,599 | A | * | 5/1984 | Scheller et al. ..... 15/22.1 |
| 4,476,604 | A | | 10/1984 | White et al. |
| 4,506,400 | A | | 3/1985 | Klein |
| 4,633,542 | A | | 1/1987 | Taravel |
| 4,680,825 | A | | 7/1987 | White et al. |
| 4,698,869 | A | | 10/1987 | Mierau et al. |
| 4,716,614 | A | | 1/1988 | Jones et al. |
| 4,744,124 | A | | 5/1988 | Wang et al. |
| 4,788,734 | A | | 12/1988 | Bauer |
| 4,881,552 | A | | 11/1989 | Heyman |
| 4,944,296 | A | | 7/1990 | Suyama |

(Continued)

FOREIGN PATENT DOCUMENTS

| | | |
|---|---|---|
| CA | 2004029 | 5/1990 |
| CA | 2232528 | 9/1999 |

(Continued)

OTHER PUBLICATIONS

AMP Connections, "Duplicating Nature But Sensing the Difference".

(Continued)

*Primary Examiner* — Shay Karls
(74) *Attorney, Agent, or Firm* — George H. Leal; Vladimir Vitenberg

(57) ABSTRACT

An oral hygiene implement comprising having a handle, head, and a neck extending between the handle and the head is described. The head has a plurality of cleaning elements and/or massaging elements attached to the head. The oral hygiene implement also has a force sensor and an output source. The output source provides a plurality of output signals which correspond to a plurality of conditions to a user.

21 Claims, 7 Drawing Sheets

(56) References Cited

U.S. PATENT DOCUMENTS

| | | | | |
|---|---|---|---|---|
| 5,105,499 | A | 4/1992 | Dirksing | |
| 5,138,733 | A | 8/1992 | Bock | |
| 5,146,645 | A | 9/1992 | Dirksing | |
| 5,165,131 | A | 11/1992 | Staar | |
| 5,282,291 | A | 2/1994 | Spieler et al. | |
| 5,315,732 | A | 5/1994 | Huefner et al. | |
| 5,323,504 | A | 6/1994 | McCusker | |
| 5,331,707 | A | 7/1994 | Irizarry | |
| 5,355,544 | A | 10/1994 | Dirksing | |
| 5,372,501 | A | 12/1994 | Shalvi | |
| 5,412,827 | A | 5/1995 | Muller et al. | |
| 5,454,133 | A | 10/1995 | Garnet | |
| 5,493,747 | A | 2/1996 | Inakagata et al. | |
| 5,502,861 | A | 4/1996 | Spieler et al. | |
| 5,561,881 | A | 10/1996 | Klinger et al. | |
| 5,673,451 | A | 10/1997 | Moore et al. | |
| 5,784,742 | A * | 7/1998 | Giuliani et al. | 15/22.1 |
| 5,815,872 | A * | 10/1998 | Meginniss et al. | 15/22.1 |
| 5,876,207 | A | 3/1999 | Sundius et al. | |
| 5,943,747 | A | 8/1999 | Muller | |
| 6,081,957 | A | 7/2000 | Webb | |
| 6,106,294 | A | 8/2000 | Daniel | |
| 6,327,734 | B1 | 12/2001 | Meginniss et al. | |
| 6,330,730 | B1 | 12/2001 | Davies et al. | |
| 6,389,636 | B1 | 5/2002 | Savill | |
| 6,397,424 | B1 | 6/2002 | Leung | |
| 6,412,137 | B1 | 7/2002 | Heidari | |
| 6,425,295 | B1 | 7/2002 | Meginniss | |
| 6,536,068 | B1 | 3/2003 | Yang et al. | |
| 6,611,780 | B2 | 8/2003 | Lundell et al. | |
| 6,654,928 | B1 | 11/2003 | Terry et al. | |
| 6,786,732 | B2 | 9/2004 | Savill et al. | |
| 6,850,167 | B2 | 2/2005 | Rosen | |
| 6,889,829 | B2 * | 5/2005 | Lev et al. | 206/362.2 |
| 6,952,855 | B2 | 10/2005 | Lev et al. | |
| 6,954,961 | B2 | 10/2005 | Ferber et al. | |
| 6,988,777 | B2 | 1/2006 | Pfenniger et al. | |
| 7,120,960 | B2 | 10/2006 | Hilscher et al. | |
| 8,006,342 | B2 * | 8/2011 | Nanda | 15/105 |
| 2003/0205492 | A1 * | 11/2003 | Ferber et al. | 206/362.2 |
| 2007/0136964 | A1 | 6/2007 | Dawley | |
| 2007/0190509 | A1 | 8/2007 | Kim | |
| 2008/0060148 | A1 | 3/2008 | Pinyayev et al. | |
| 2008/0109973 | A1 | 5/2008 | Farrell et al. | |
| 2009/0320227 | A1 | 12/2009 | Cohen et al. | |

FOREIGN PATENT DOCUMENTS

| | | |
|---|---|---|
| CH | 609 238 A5 | 2/1979 |
| DE | 40 12 413 A1 | 10/1991 |
| DE | 19506129 | 8/1996 |
| DE | 29923180 | 5/2000 |
| DE | 10128610 | 1/2002 |
| EP | 0 481 553 A1 | 4/1992 |
| JP | 3-173558 | 7/1991 |
| JP | 4189303 | 7/1992 |
| JP | 5-154015 | 6/1993 |
| JP | 5329024 | 12/1993 |
| JP | 7236519 | 9/1995 |
| JP | 10108734 | 4/1998 |
| WO | WO 92/13499 | 8/1992 |

OTHER PUBLICATIONS

PCT International Search Report dated Oct. 28, 2010.

* cited by examiner

PRESSURE INDICATOR FOR AN ORAL CARE INSTRUMENT

CROSS REFERENCE OF RELATED APPLICATION

This application claims the benefit of provisional application Ser. No. 61/220,623, filed on Jun. 26, 2009, which is incorporated by reference in its entirety herein.

FIELD OF THE INVENTION

The present invention pertains to a personal hygiene device, more particularly to a personal hygiene device including a pressure indication system.

BACKGROUND OF THE INVENTION

The utilization of toothbrushes to clean one's teeth has long been known. During the brushing process, a user generally applies a force to the brush which is applied against the teeth and gums by the cleaning elements of the toothbrush. A minimum level of force must be applied to remove plaque and debris; however, high levels of force may have negative health consequences for an individual. For example, issues such as gum irritation, or over periods of time, gum recession or tooth enamel abrasion may occur. Unfortunately, the presence of these issues may exacerbate a contributing factor to the issues, i.e. high brushing force. Because some users may feel that these issues stem from poor cleaning, in an effort to correct the issues the users may apply even more force during brushing which in turn may cause more gum irritation and/or gum recession or tooth enamel abrasion.

In order to avoid or mitigate these issues, dental professionals recommend the use of a soft bristled toothbrush. However, even with the use of a soft bristled toothbrush, high brushing forces may still lead to theses issues. Furthermore, it is extremely difficult for an individual, when brushing, to determine the optimal force required for cleaning. One may feel a minimum level of force is needed to enable cleaning, but feeling the level at which the force is too high is difficult. In addition, studies have shown that the cleaning ability of a toothbrush may in fact be reduced if brushing force is increased to too high a level.

Other recommended solutions may be to apply less force while brushing. However, if too little force is applied during brushing, the cleaning efficacy of the toothbrush often is reduced. Furthermore, similar to high brushing forces, the individual may find it difficult to determine when brushing forces are too low.

Accordingly, a need exists for a personal hygiene implement which signals to the user when too high a brushing force is being applied, when too low a brushing force is being applied and/or when a sufficient amount of brushing force is being applied.

SUMMARY OF THE INVENTION

The personal hygiene implement of the present invention can provide feedback to the user regarding too high of an applied brushing force, too low of an applied brushing force, a sufficient amount of brushing force, a lower end of a range of the sufficient brushing force; and/or a high end of the range of the sufficient brushing force. In providing this feedback to a user, the personal hygiene implement of the present invention can assist the user in achieving better results when utilizing the personal hygiene implement.

In some embodiments, an oral hygiene implement comprises a handle, a head, and a neck extending between the handle and the head. The head comprises a plurality of cleaning elements and/or massaging elements. The oral hygiene implement further comprises a force sensor and an output source which is in signal communication with the force sensor. The output source is configured to provide a plurality of signals to a user, the plurality of output signals corresponding to a plurality of conditions, wherein the plurality of conditions comprises at least two of too little applied force, too much applied force, a sufficient amount of force, a lower end of a range of sufficient force, and an upper end of the range of sufficient force.

In some embodiments, the output source is a light emitting element, and the light emitting element is positioned such that light from the light emitting element shines upon the face of the user when the light emitting element is activated.

In some embodiments, the force sensor includes a load member, a compliant element, and a switch. The load member is pivotably disposed, at least in part, within the handle. The compliant element provides a force on the load member thereby inducing a moment in a first direction about a pivot point of the load member. An applied brushing force induces a moment in a second direction about the pivot point, and the second direction is different from the first direction. The switch is in signal communication with the output source, and the output source is configured to provide a signal to a user. The signal corresponds to a condition which comprises at least one of too little applied force, too much applied force, a sufficient amount of force, a lower end of a range of sufficient force, and an upper end of a range of sufficient force.

In some embodiments, the output source provides a first output signal and a second output signal, wherein the first output signal corresponds to too little force being applied, and wherein the second output signal corresponds to too much force being applied.

In some embodiments, the output source provides a first output signal and a second output signal, wherein the first output signal corresponds to a lower end of a range of sufficient force, and wherein the second output signal corresponds to an upper end of the range of sufficient force.

DETAILED DESCRIPTION OF THE INVENTION

Figure 1:
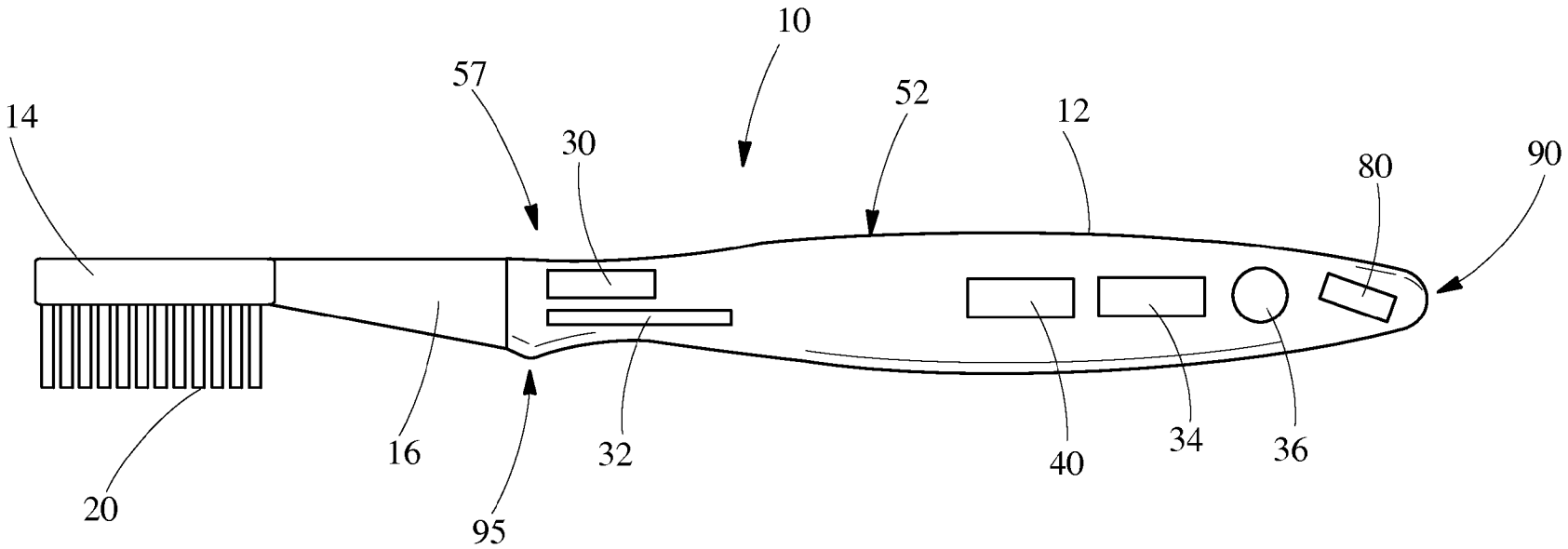
FIG. 1 is a partial cross sectional view of a personal hygiene implement, e.g. a toothbrush, constructed in accordance with the present invention.

Definitions:

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

As used herein "personal hygiene implement" refers to any implement which can be utilized for the purposes of personal hygiene. Some suitable examples include toothbrushes, either manual or powered; razors, either manual or powered; shavers, either manual or powered; trimmers, etc.

As used herein, "oral hygiene implement" refers to any device which can be utilized for the purposes of oral hygiene. Some suitable examples of such devices include toothbrushes (both manual and power), flossers (both manual and power), water picks, and the like.

Description:

For ease of explanation, the oral hygiene implement described hereafter shall be a manual toothbrush; however, as stated above, an oral hygiene implement constructed in accordance with the present invention is not limited to a manual toothbrush construction. Additionally, the embodiments described hereafter are equally applicable to blades, razors, other personal hygiene implements, or the like.

As shown in FIG. 1, in one embodiment, a toothbrush 10 comprises a handle 12, a head 14, and a neck 16 extending between the handle and the head 14. A plurality of cleaning elements 20 are attached to the head 14. The toothbrush 10 may further comprise an output source 30, a force sensor 32, a timer 34, a processor 40, and a power source 36.

The output source 30 may be in electrical communication with the force sensor 32 and provide an output signal to a user when the user applies too much force, too little force, and/or a sufficient force during their oral hygiene routine. Any suitable output signal may be provided to the user. Some suitable examples of output signals include vibration (tactile), audible, visual, the like, or combinations thereof. For example, where the output signal is vibration, the output signaling element 30 may comprise a motor which rotates an eccentric weight. As another example, where the output signal is audible, the output signaling element 30 may comprise a horn, piezo audio indicator, magnetic audio indicator, audio transducer, speaker, buzzer, and/or like.

As yet another example, where the output signal is tactile, the output signaling element 30 may comprise a cammed shaft, which upon rotation may apply pressure to a membrane which in turn applies pressure to a finger of the user. As yet another example, where the output signaling element is visual, the output signaling element 30 may comprise an LED or multiple light output devices, e.g. a bar graph. Combinations of these signals are also contemplated. Additionally, any suitable number of signals can be utilized.

Signals can be provided to the user for a number of different conditions. For example, the output signaling element 30 may be configured such that the user is only provided a single signal which corresponds to one of the following conditions: (1) too little force is being applied; (2) too much force is being applied; or (3) a sufficient force is being applied. As yet another example, the output signaling element 30 may be configured such that the user is provided with two signals which are selected from the following conditions: (1) too little force is being applied; (2) too much force is being applied; and/or (3) a sufficient force is being applied. As yet another example, the output signaling element 30 may be configured to provide to the user more than two signals. In such embodiments, the output signaling element 30 may be configured to provide to the user a signal for each of the following conditions: (1) too little force is being applied; (2) too much force is being applied; and/or (3) a sufficient force is being applied. Other contemplated conditions for which signals can be provided to the user include limits for the sufficient force. For example, high and low ends of a range of the sufficient force can be signaled to the user. In such examples, a lower end of the range of the sufficient force and/or an upper end of the range of the sufficient force can be signaled to the user. In this regard, a sufficient force range can be developed to allow some flexibility to the user.

Several considerations can be taken into account when trying to evaluate the above conditions. For example, mouth feel, cleaning efficacy, etc. With regard to mouth feel, for example, oral care implements comprising cleaning elements which are very soft can generally provide a comfortable mouth feel to a user at forces which are higher than those oral care implements having more stiff cleaning elements. As another example, cleaning elements which comprise elastomeric materials may be more comfortable for a user and therefore may allow a higher force to be applied during brushing while still being within the user's comfort level. With regard to efficacy, cleaning elements having surface features, as described in U.S. Pat. Nos. 5,722,106; 5,836,769; 6,058,541; 6,018,840; U.S. Patent Application Publication Nos. 2006/0080794; 2006/0272112; and 2007/0251040, may require a lower force during brushing to provide sufficient cleaning/plaque removal when compared to cleaning elements having smooth surface features.

Another consideration which can be taken into account includes clinical safety. For example, a force which provides good mouth feel to consumer may cause gum irritation, gum recession, and/or tooth enamel abrasion.

Several variables can affect the considerations above, e.g. mouth feel, cleaning efficacy, clinical safety. For example, users may apply a specific brushing force while utilizing a powered toothbrush and a different force while utilizing a manual toothbrush. As another example, length of the cleaning elements, cross sectional shape of the cleaning elements, e.g. diameter, bending properties, etc. Because of the numerous variables which can impact the above considerations, consumer testing, clinical testing, and/or robot testing may be utilized to empirically determine values for: (1) too little force being applied; (2) too much force being applied; and/or (3) sufficient force being applied; (4) a low end of the sufficient force range being applied; and/or (5) a high end of the sufficient force range being applied, which can still provide comfortable mouth feel, cleaning efficacy, and clinical safety.

Consumer testing and/or clinical testing may provide some insight as to an appropriate value for the upper end of the tolerance of a sufficient force for a particular brush and/or an appropriate value for the lower end of the tolerance of the sufficient force for the particular brush. In general, consumers would try a particular toothbrush and can apply a prescribed force while brushing. After brushing, the consumers may be asked to provide feedback with regard to the feel of the brush in the oral cavity. Additionally, plaque scans can be taken of the oral cavities of consumers prior to brushing and then post brushing. Comparison can be made of the before and after in order to determine efficacy at a particular force. Moreover, clinical testing can be performed on the upper end of the range of the sufficient force to determine whether gum irritation, gum recession, and/or tooth enamel abrasion occurs at this value.

Similarly, robot testing may be utilized to determine efficacy of a particular brush at a given force. In robot testing, generally, a toothbrush is operated by a robot arm which moves the toothbrush in a brushing motion across teeth of a model of an oral cavity. Generally, the teeth of the model are covered by a synthetic plaque which is well known in the art. The robot arm can apply a predetermined force to the toothbrush during the simulation. After the simulation, plaque analysis of the before brushing and after brushing can be compared. From the before and after plaque analysis, a cleaning/efficacy determination can be made. Through iteration, the lower level of sufficient force range may be determined for any cleaning element/massaging element configuration.

Each of consumer testing, clinical testing, and robot testing can provide useful information on the values of force associated with the conditions: (1) too little force being applied; (2) too much force being applied; and/or (3) a sufficient force being applied; (4) a lower end of the sufficient force range being applied; and/or (5) an upper end of the sufficient force range being applied, which can still provide comfortable mouth feel as well as cleaning efficacy.

In some embodiments, a value of too much force may be greater than or equal to about 1 Newton, 1.25 Newtons, 1.5 Newtons, 1.75 Newtons, 2.00 Newtons, 2.10 Newtons, 2.20 Newtons, 2.30 Newtons, 2.40 Newtons, 2.50 Newtons, 2.60 Newtons, 2.75 Newtons, 2.85 Newtons, greater than or equal to about 3.00 Newtons, greater than or equal to about 3.50 Newtons, greater than or equal to about 3.75 Newtons, greater than or equal to about 4.00 Newtons, greater than or equal to about 4.25 Newtons, greater than or equal to about 4.50 Newtons, greater than or equal to about 4.75 Newtons, greater than or equal to about 5.00 Newtons, greater than or equal to about 5.25 Newtons, greater than or equal to about 5.50 Newtons, greater than or equal to about 5.75 Newtons, or greater than or equal to about 6.00 Newtons. In some embodiments, a value of too little force being applied may be less than or equal to about 5.00 Newtons, about 4.75 Newtons, about 4.5 Newtons, about 4.25 Newtons, about 4.00 Newtons, about 3.75 Newtons, about 3.5 Newtons, about 3.25 Newtons, about 3.00 Newtons, about 2.75 Newtons, about 2.50 Newtons, about 2.25 Newtons, about 2.00 Newtons, about 1.75 Newtons, about 1.50 Newtons, about 1.25 Newtons, about 1.00 Newtons, about 0.75 Newtons, or about 0.50 Newtons. In some embodiments, values for a low end of a sufficient force range, an upper end of the sufficient force range, and/or the sufficient force range may be selected from any of the values provided above with regard to the too much force and/or too little force conditions.

As stated above, combinations of signals can be utilized for any combination of conditions. For example, to signal the user that too little force is being applied, a first signal may be audible while a second signal signifying too much force may be visual. Any suitable combinations of signals can be utilized. As yet another example, to signal the user that too little force is being applied, a first signal may be visual and comprise a first color while a second signal signifying too much force may be a second color which contrasts with the first color. Any suitable colors may be utilized, e.g. red, green, yellow, blue, purple, the like, or combinations thereof. Such combinations of signals may also be applied where the output source 30 is configured to provide a signal for a sufficient force and/or upper and lower values thereof.

The signal provided to the user may be constant, e.g. provide a signal to the user during the entire brushing routine. Alternatively, the signal provided to the user can be provided at the end of the brushing routine. For example, where the user applied too high of a force during the majority of brushing routine, the signal provided to the user may flash red or show a red visible signal for a predetermined time period. As another example, where the user applied too low of a force during the majority of the brushing routine, the signal provided to the user may flash yellow or show a yellow visible signal for a predetermined period of time. As yet another example, where the user applied a sufficient force during the majority of the brushing routine, the signal provided to the user may flash green or show a green visible signal for a predetermined period of time.

In other embodiments, the signal can be provided to the user intermittently during the brushing routine. For example, the signal can be provided to the user on predetermined time intervals. For example, a signal may be provided to the user every 20 seconds. Any suitable time interval can be selected. For example, the time interval between signals can be greater than about 0.1 second, greater than about 0.2 seconds, greater than about 0.3 seconds, greater than about 0.4 seconds, greater than about 0.5 seconds, greater than about 0.6 seconds, greater than about 0.7 seconds, greater than about 0.8 seconds, greater than about 0.9 seconds, greater than about 1 second, greater than about 2 seconds, greater than about 3 seconds, greater than about 4 seconds, greater than about 5 seconds, greater than about 6 seconds, greater than about 10 seconds, greater than about 15 seconds, greater than about 20 seconds, greater than about 25 seconds, greater than about 30 seconds, greater than about 40 seconds, greater than about 50 seconds, greater than about 60 seconds, and/or less than about 60 seconds, less than about 50 seconds, less than about 40 seconds, less than about 30 seconds, less than about 25 seconds, less than about 20 seconds, less than about 15 seconds, less than about 10 seconds, less than about 5 seconds, less than about 4 seconds, less than about 3 seconds, less than about 2 seconds, less than about 1.5 seconds, less than about 1, less than about 0.9 seconds, less than about 0.8 seconds, less than about 0.7 seconds, less than about 0.6 seconds, less than about 0.5 seconds, less than about 0.4 seconds, less than about 0.2 seconds, or less than about 0.1 seconds.

Referring to FIGS. 2A-2H, additional embodiments where the output signal comprises a visual component are contemplated. For example, as stated above, the visual output signal may comprise a series of light sources 310A-310E which form a bar graph. For situations of low force, the number of light sources energized may be less than the number of light sources energized for situations of high force. For example, to signal the user with regard to a low force, a single light source 310A may be energized; to signal a high force five light sources 310A-310E may be energized, while to signal a sufficient force two light sources, e.g. 310A and 310B may be energized. As yet another example, to signal the user with regard to a low force, a single light source 310A in a first position 320 may be energized; to signal a high force a single light source 310E in a second position 360 may be energized; and to signal a sufficient force, a single light source 310C in a third position 340 may be energized. In another example, to signal a user with regard to a lower end of a range of sufficient force a light source 310B may be energized in a position 330. In another example, to signal a user with regard to an upper end of the range of sufficient force a light source 310D may be energized in a position 350. Embodiments are contemplated where the light sources 310A-310E contrast in color. Additional embodiments are contemplated where a single light source, e.g. 310A, can provide a plurality of contrasting colors depending upon the signal provided to the user.

For output signals which comprise a visible signal, placement of a light source, e.g. 310A-310E may be in any suitable location. Referring back to FIG. 1, some examples of suitable locations include between the head 14 and the neck 16; between the neck 16 and the handle 12. While the light source, e.g. 31A-310E, may be placed on the handle 12, there is a tendency for the light source to be blocked from the view of the user by the user's hand. To facilitate viewing by the user, an area 57 overlapping the neck 16 and the handle 12 can be particularly beneficial for the location of the light source. The area 57 may be disposed on a backside surface 52 of the toothbrush.

Additionally, the light source can be selected such that the light source has a wide dispersion angle. The light source can be positioned on the toothbrush such that the light emitted from the light source is in the line of sight of the user. In some embodiments, the light source can be positioned such that the light emitted from the light source shines on the face of the user. For example, the light from the light source can light up the user's face when activated. This shining of the light on the user's face can facilitate the viewing by the user even in the absence of a mirror. In such embodiments, the light source can be positioned asymmetrically with respect to a longitudinal axis of the toothbrush 10. In such embodiments, the light source may be positioned at an angle towards the face of the user.

For those toothbrushes which utilize vibrational devices in order to provide some degree of movement to cleaning elements and/or massaging elements, e.g. U.S. Patent Application Publication Nos. 2006/0272112 and 2007/0251040, the output signal to the user of either too much force; too little force; a low end of a sufficient force range, and/or a high end of a sufficient force range, may be the absence of vibration. In other embodiments, the output signal may be provided to the user by increasing and/or decreasing the speed of the vibrational device such that the user perceives a difference in the toothbrush and/or the vibrational device.

Where the output signal comprises, in part, vibration, the vibrational device may be situated in any suitable location. For example, again referring back to FIG. 1, a vibrational device 80 may be positioned in the handle 12 near a grip end portion 90 of the handle. As another example, the vibrational device 80 may be positioned in the handle 12 near the area 57. For those embodiments for which vibration is utilized during the oral care routine, a second vibrational device can be added to the toothbrush 10 for signaling purposes. The first vibrational device may be utilized to deliver a vibrational benefit to the cleaning elements 20 and the second vibrational device, e.g. vibrational device 80, may be utilized to deliver an output signal to the user.

The output source 30 may be provided on the toothbrush in any suitable location, e.g. handle 12, neck 16, and/or head 14. For example, the output source 30 may be disposed within the toothbrush 10; on the surface of the toothbrush 10; or partly within and partly exterior to the toothbrush 10.

In some embodiments, the output source 30 may comprise an external display which is in signal communication with the toothbrush 10. In such embodiments, the external display and the toothbrush 10 may communicate with one another via any suitable manner. Some suitable examples of communication between a personal hygiene device, e.g. toothbrush, and an external display are described in U.S. Patent Application Ser. Nos. 61/176,618, entitled, "PERSONAL CARE SYSTEMS, PRODUCTS, AND METHODS", filed on May 8, 2009; 61/180,617, entitled, "PERSONAL CARE SYSTEMS, PRODUCTS, AND METHODS", filed on May 22, 2009; and U.S. Patent Application Publication No. 2008/0109973. In such embodiments, the signals discussed herein may be provided to the user via the external display.

The force sensor 32 may be positioned on the toothbrush 10 in any suitable location. For example, as shown in FIG. 1, the force sensor 32 may be disposed within the toothbrush 10. As another example, the force sensor 32 may be disposed partly within and partly exterior of the toothbrush 10. Any suitable force sensor 32 may be utilized. Some suitable examples include a pressure transducer, a pressure sensitive film, and/or threshold sensors.

Figure 3A:
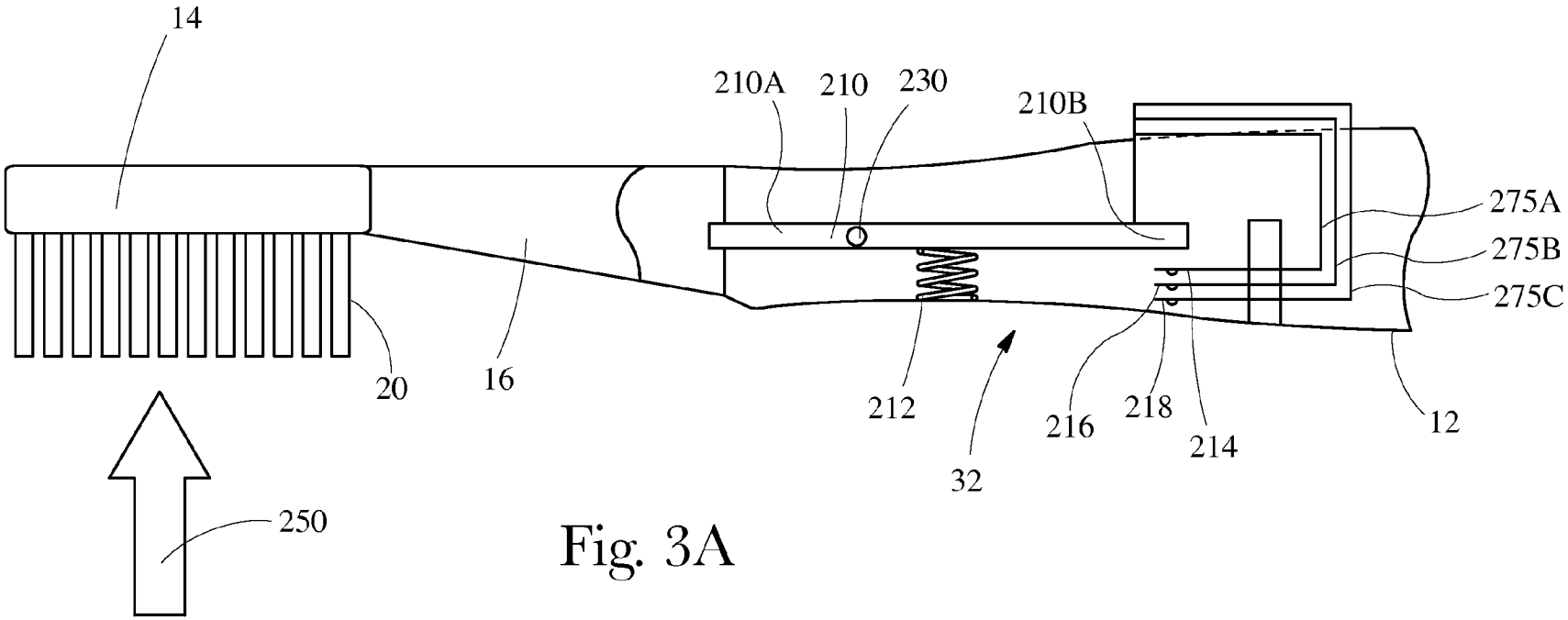
FIGS. 3A and 3B are partial cross sectional views of a toothbrush constructed in accordance with the present invention.

With regard to FIG. 3A, in one embodiment, the force sensor 32 may comprise at least one threshold sensor 202. In one embodiment, the threshold sensor 202 may comprise a load member 210, a compliant element 212, and a plurality of switches, e.g. a first switch 214, a second switch 216, and a third switch 218. As shown, the load member 210 may extend from the neck 16 into the handle 12. The load member 210 may pivot about pivot point 230. Embodiments having only a single switch are also contemplated.

Figure 2A:
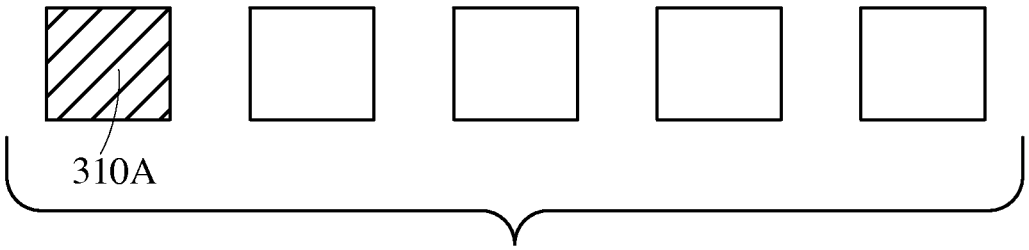
FIGS. 2A-2H are schematic views of visual output signals from a personal hygiene implement constructed in accordance with the present invention.
Figure 2B:
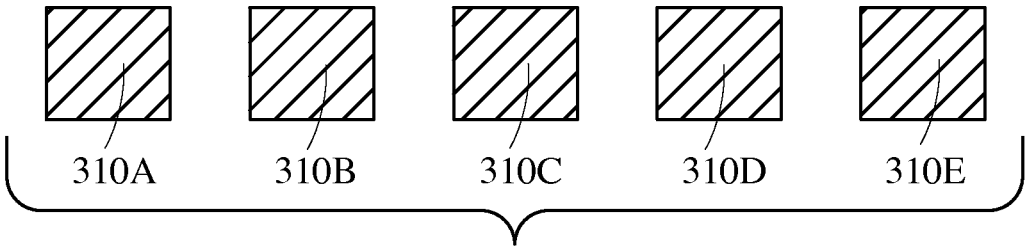
Figure 2C:
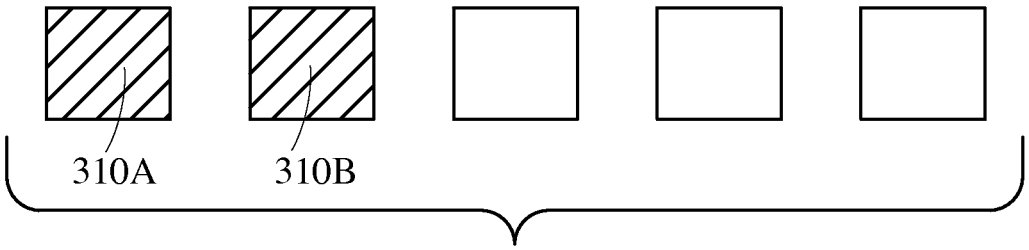
Figure 2D:
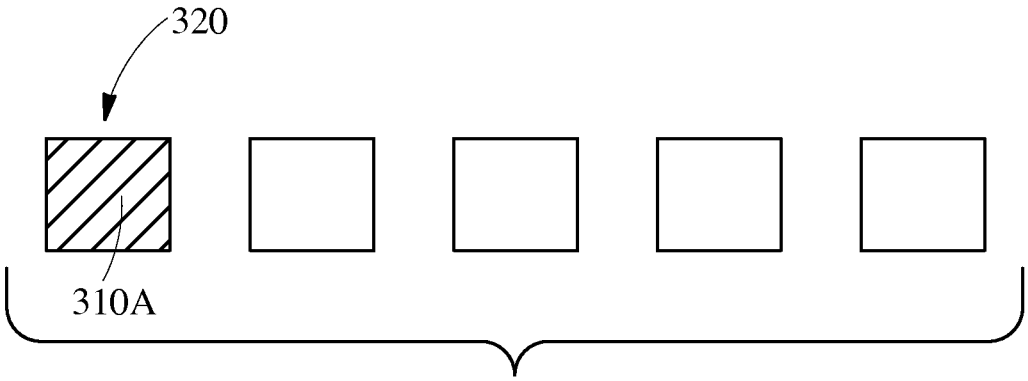
Figure 2E:
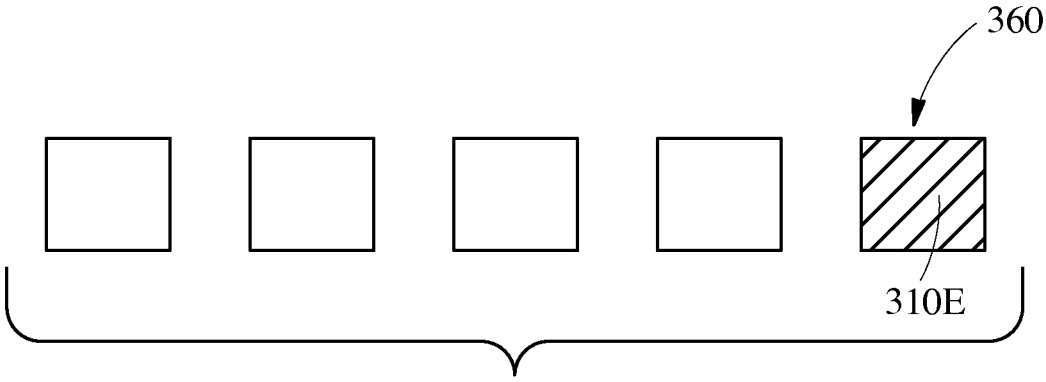
Figure 2F:
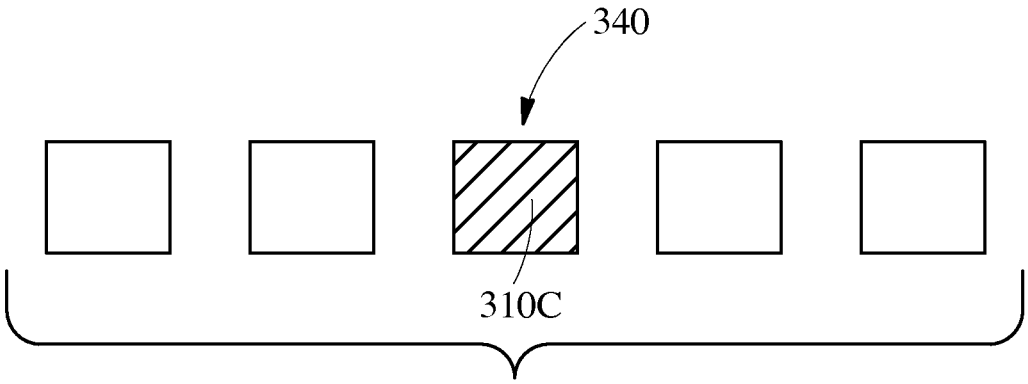
Figure 2G:
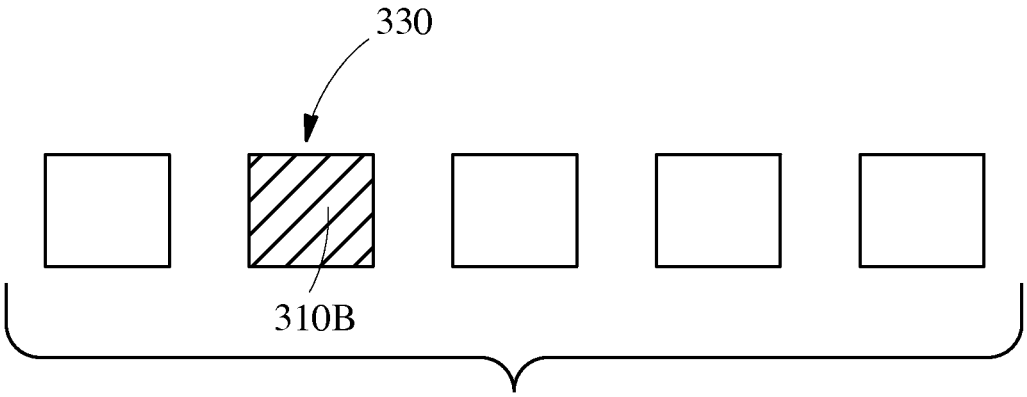
Figure 2H:
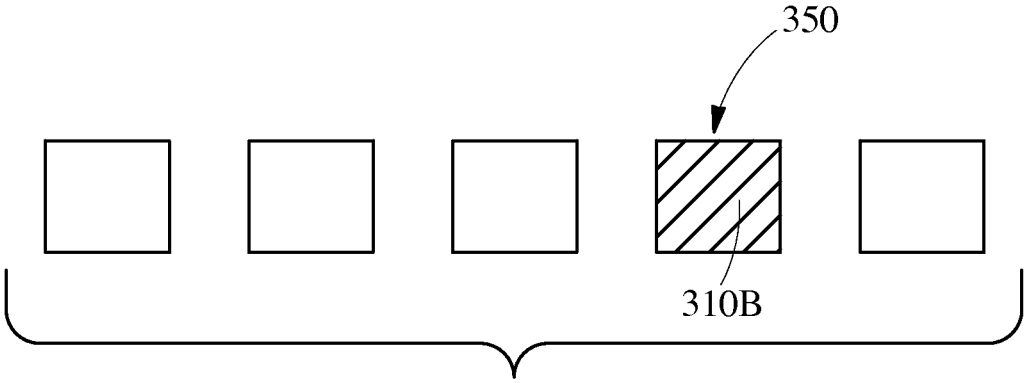

In operation, in some embodiments, the neck 16 and/or the head 14 may be pivotably connected to the handle 12 and/or translationally connected to the handle 12. In an at rest state, i.e. no applied brushing force 250, the load member 210 may not be in contact with any switch. However, when a brushing force 250 is applied to the plurality of cleaning elements 20, the head 14 and/or neck 16 may pivot and/or translate with respect to the handle 12. The pivoting and/or translation of the head 14 and/or neck 16 can cause the load member 210 to pivot and/or translate with respect to the handle 12. In the embodiment of FIG. 2A, if the brushing force 250 is sufficient to overcome the force exerted on the load member 210 by the compliant element 212 such that a distal end 210B of the load member 210 contacts the first switch 214, the load member 210 may complete a first circuit 275A, thereby energizing the first circuit 275A. Energizing the first circuit 275A can energize the output source 30 (shown in FIG. 1) which can provide the user with a first output signal.

If additional brushing force 250 is applied, the load member 210 may pivot and/or translate further and cause the distal end 210B of the load member 210 to contact second switch 216, and/or force the first switch 214 into the second switch 216. Closing the second switch 216 energizes a second circuit 275B. In completing the second circuit 275B, the output source 30 (shown in FIG. 1) may provide the user with a second output signal. The second output signal can be different from the first output signal in any perceivable manner.

If further brushing force 250 is applied, the load member 210 may pivot further and cause the distal end 210B of the load member 210 to contact the third switch 218 and/or force the first switch 214 and second switch 216 into the third switch 218. Closing the third switch 218 energizes a third circuit 275C. In completing the third circuit 275C, the output source 30 (shown in FIG. 1) may provide the user with a third output signal.

The first output signal, the second output signal, and the third output signal may correspond to any of the conditions described heretofore. Additionally, the first output signal, the second output signal, and/or the third output signal may differ from one another in any perceivable manner, some examples of which are described herein.

Figure 4:
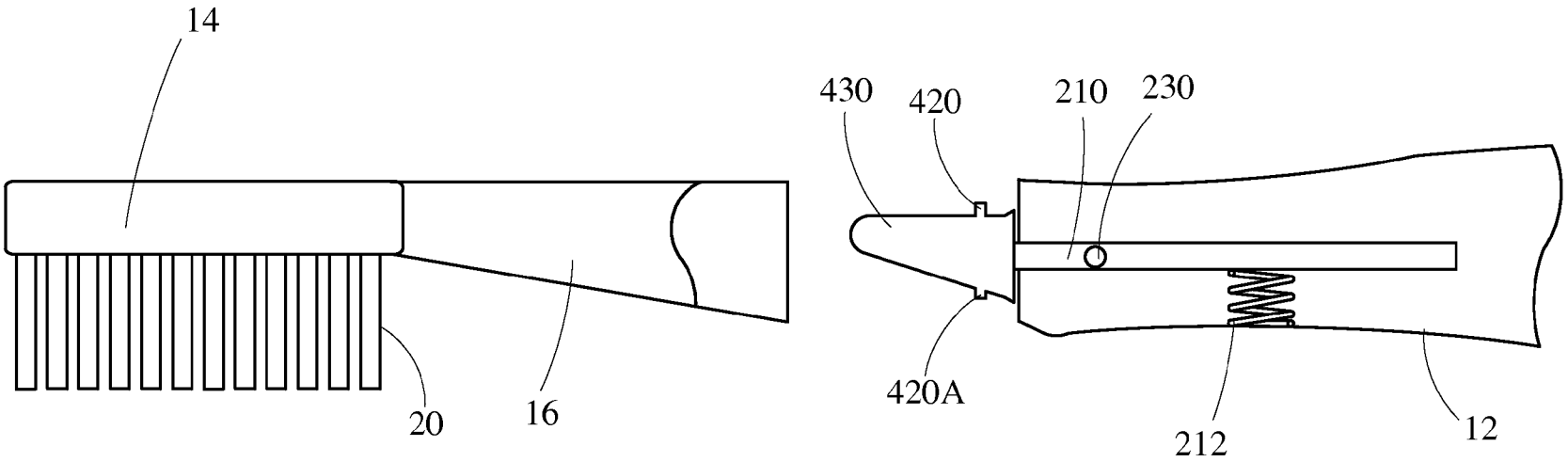
FIG. 4 is a partial cross sectional view of a toothbrush constructed in accordance with the present invention and showing the feature of a removable neck/head.

As shown, the pivot point 230 is disposed in the handle. This configuration is particularly beneficial for toothbrushes where the neck 16 and/or head 14 are replaceable. In such configurations, the neck 16 and/or the head 14 may include a receiving region for reception of a proximal end 210A of the load member 210 upon attachment to the handle 12. Alternatively, the load member 210 may be integrally connected with the neck 16 and/or head 14. Other embodiments of replaceable neck 16 and/or head 14 devices are described with regard to FIG. 4. For those embodiments where the load member 210 translates, the pivot point 230 may not be required.

The compliant element 212 may be any suitable element which stores energy from the movement of the load member 210, in some embodiments. Additionally, in some embodiments, the compliant element 212 may be any suitable element which returns the load member 210 to an initial position in the absence of the brushing force 250. Some suitable examples of compliant elements 212 include, but are not limited to, springs; elastic materials, e.g. rubber-plastic, thermoplastic elastomers, styrenic based elastomers, blends of elastomers and other polymers, e.g. polypropylene; gas, liquid, and/or gel filled devices (e.g. elastomeric enclosures, containers, e.g. balloons, bladders; compressible gas cylinders, elastically overmolded structure, the like, and/or combinations thereof. In a specific embodiment, a suitable compliant element 212 includes a stainless steel spring available from McMaster Carr, located at 200 New Canton Way, Robbinsville, N.J. 08691-2343 and sold as PN9663K54 and cut to a length of 0.40 with the ends of the spring ground. Additionally, a plurality of compliant elements can be utilized if desired.

The compliant element 212 may be positioned in any suitable location based upon the desired moment to be applied to the load member 210. In some embodiments, the compliant element 212 may be sized to provide a sufficient force to counteract a lower threshold of brushing force 250.

Figure 3B:
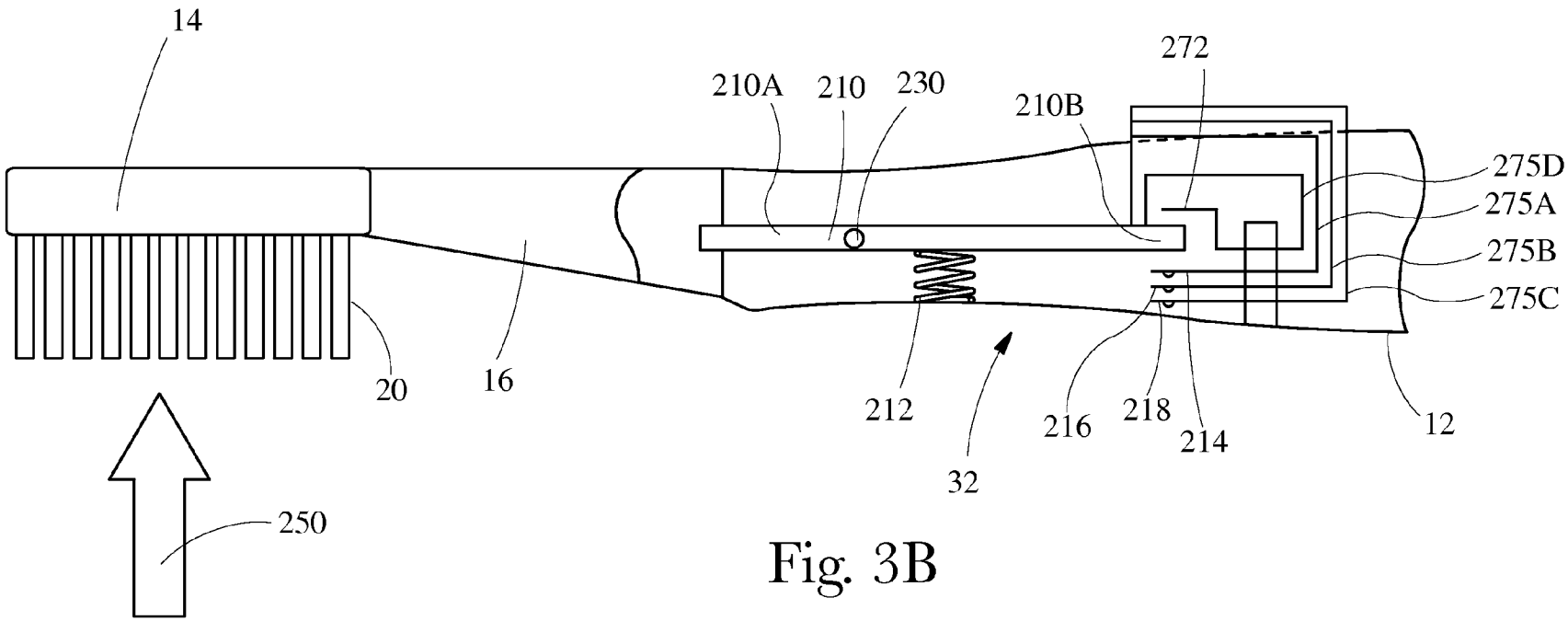

Referring to FIGS. 3A and 3B, in an at rest state, no applied brushing force 250, the compliant element 212 may be configured such that the load member 210 is in contact with a fourth switch 272. The fourth switch 272 can be in electrical communication with the output source 30 (shown in FIG. 1) and may complete a fourth circuit 275D. The energizing of the fourth circuit 275D may provide an output signal to the user that too little brushing pressure is being applied. Upon application of brushing force 250, the distal end 210B of the load member 210 may disengage with the fourth switch 272 thereby de-energizing the fourth circuit 275D. If sufficient brushing force 250 is applied, the distal end 210B of the load member 210 may remain relatively stationary and not in contact with any switches, 214, 216, 218, and/or 272, thereby closing none of the switches. This may cause the output source 30 (shown in FIG. 1) to provide no signal to the user which may correspond to sufficient brushing force.

The load member 210 may be, in some embodiments, any suitable conductive material. Some examples of suitable materials include aluminum, copper, lead, steel, the like, and/or combinations thereof. Additionally, in some embodiments, the load member 210 may comprise a conductive polymer. Additionally, in some embodiments, electrically conductive non-metallic materials may be utilized, e.g. electrically conductive polymers.

The term "electrically conductive non-metallic materials" as used herein includes materials comprising one or more non-metals and one or more metals, such as polymeric compositions containing metal particles. Often such compounds are made by mixing solid conductive particles such as carbon black, stainless steel fibers, silver or aluminum flakes or nickel-coated fibers with electrically insulating bulk thermoplastics, for example polystyrene, polyolefins, nylons, polycarbonate, acrylonitrile-butadiene-styrene co-polymers (ABS), and the like.

Recently, there has been an increased interest in replacing carbon black or metal particle-filled compounds of the above-described type with intrinsically electrically conductive polymers and their blends with common insulating polymers including, but not limited to polyanilines. Polyaniline (or abbreviated PANI) and its synthesis and the preparation of the electrically conductive form of this polymer by, for example, contacting polyanilines with protonic acids resulting in salt complexes has been described in the prior art. Additionally, electrically conductive polymers are known and used in industrial settings, particularly in the manufacture of electronic component parts. Some examples of electrically conductive polymer compositions are illustrated in U.S. Pat. Nos. 5,256,335; 5,281,363; 5,378,403; 5,662,833; 5,958,303; 6,030,550; and 6,149,840. Additional electrically conductive polymer compositions are described in U.S. Pat. Nos. 5,866,043 and 6,685,854. The term "electrically conductive non-metallic materials" as used herein also includes these types of compositions.

Another electrically conductive substrate suitable for use in the present invention is discussed in U.S. Pat. Nos. 6,291,568, 6,495,069, and 6,646,540. This substrate has a first level of conductance when quiescent, or inactive, and a second level of conductance resulting from a change of stress; i.e. mechanical or electrical stress. The mechanical stress can include stretching and/or compressing. This substrate comprises a granular composition, each granule of which comprises at least one substantially non-conductive polymer and at least one electrically conductive filler. The conductive filler can be one or more metals, other conductive or semi-conductive elements and oxides or intrinsically conductive semi-conductive inorganic or organic polymers. The granules are typically up to 1 mm, and the granule (conductor) to polymer volumetric ratio is suitably at least 3:1. It is contemplated that other substrates which conduct electricity when compressed are suitable for use in the present invention.

In some embodiments, the load member 210 may be non-conductive. In such embodiments, the load member 210 may be formed of a variety of materials. In general, the load member 210 material should be selected such that the load member 210 can withstand forces, e.g. no permanent deformation, minimal deflection if any, applied during brushing as well as the force applied to the load member 210 by the compliant element 212. Additionally, suitable materials may be non-corrosive and stiff. Some suitable examples of materials which may be utilized for the load member 210 include stainless steel, plated steel, high density plastics, the like, and/or combinations thereof.

Any suitable switches can be utilized. An example of a suitable switch is provided by Omron Electronics Inc.—ECB Division, located at 701 Brooks Avenue South, Thief River Falls, Minn. 56701 and sold under the Digi-Key Part Number of SW418-ND. Other suitable examples include any self returning switch, momentary tact, reed, leaf, push button, snap, membrane, magnetic, Hall Effect sensor, the like, and/or combinations thereof. In some embodiments, the switch may be selected such that the switch is in a normally open position.

Referring back to FIG. 1, as stated previously, the toothbrush 10 of the present invention may further comprise a processor 40. The processor 40 may be utilized to log the performance of the user for the duration of the brushing regimen. For example, the user may brush for a predetermined time period, .e.g. two minutes, after such time period the processor 40 may cause the output source 30 to provide the user with a signal that a sufficient force was applied for the duration of the two minute period. As another example, the processor 40 may cause the output source 30 to provide the user with a signal that a sufficient force was applied for about half of the two minute period. As yet another example, the processor 40 may cause the output source 30 to provide the user with a signal that a high force was applied for all and/or more than fifty percent of the two minute period. As yet another example, the processor 40 may cause the output source 30 to provide the user with a signal that a low force was applied for all and/or more than fifty percent of the two minute period. The signals provided to the user may include those signals previously described herein.

Additionally, the processor 40 may be useful in eliminating force spikes from indication. In such embodiments, the processor 40 may serve as a buffer for the output source 30 by building in a time delay between occurrence of the condition and the provided signal by the output source 30. For example, the processor 40 may be configured to include a five second time delay such that an applied brushing force which is too high must remain too high for at least five seconds before the processor 40 causes the output source 30 to provide a signal to the user. Configured as such, the processor 40 may filter the input from the force sensor 32 such that the output source 30 does not cause a plurality of flashing signals to the user. The time delay may be any suitable delay. For example, in some embodiments, the time delay may be less than about 10 seconds, less than about 9 second, less than about 8 second, less than about 7 second, less than about 6 second, less than about 5 seconds, less than about 4 seconds, less than about 3 seconds, less than about 2 seconds, less than about 1 second, less than about 0.75 seconds, less than about 0.5 seconds, less than about 0.25 seconds, less than about 0.10 seconds.

Other suitable mechanisms to reduce and/or eliminate force spikes may be utilized. For example, in some embodiments a low pass filter of at least the first order may be utilized. In such embodiments, the low pass filter may preclude a force spike from being transmitted to the output source 30 because of the high frequency of the force spike. As another example, the processor 40 may be programmed to include a digital filter which can eliminate force spikes from causing signal output.

Previously, a time interval between signals was discussed. In some embodiments, the processor 40 may be configured to modify the time interval between the signals provided to the user either during a particular brushing routine or over a series of brushing routines. For example, during a first brushing routine, if the user alternates between too much force and/or too little force, the interval between signals to the user may be at a first time interval. However, if in the first brushing routine, the user also provides a force which is predetermined to be within the sufficient force range, the signals to the user may be at a second time interval. In such an embodiment, the first time interval may be less than the second time interval thereby providing more feedback to the user. In some embodiments, the time intervals may be switched such that the user if provided more feedback for forces which are within the predetermined sufficient force range.

As stated previously, the processor 40 may similarly modify the time interval between signals provided to the user over a series of brushing routines. For example, during a first brushing routine, the user may apply too much force and/or too little force for a majority of a time period of the first brushing routine. During the first brushing routine, the time interval between signals may be at a first time interval. The processor 40 may be configured to process data regarding applied force during the first brushing routine and modify the time interval for the next brushing routine. For example, for a second brushing routine, based upon the data of the first brushing routine, the processor 40 may modify the time interval between signals during the second brushing routine to a second time interval. The second time interval may be less than the first time interval such that the user may be provided more feedback during the second brushing routine. If during the second brushing routine, the user, for a majority of the time period of the second brushing routine, applies a force within a range of sufficient force, then the processor 40 may modify the time interval between signals for a third brushing routine. For example, the time interval between signals for the third brushing routine may be less than the second time interval. However, if during the second time interval, the user applies, for a majority of the second brushing routine a force which is too high and/or too low for a majority of the time period of the second brushing routine, then the processor 40 may adjust the time interval between signals for the third brushing routine to be less than the second time interval such that the user may be provided with even more feedback than in the second brushing routine. In some embodiments, the processor may be configured to provide more feedback with regard to a force within the range of sufficient force at increasing and/or decreasing time intervals.

In some embodiments, the toothbrush 10 may include a replaceable head 14 and/or neck 16. Specifically, the head 14 may be removable from the neck 16 and/or the neck 16 may be removable from the handle 12. Hereafter, whether the head 14 is removable from the neck 16 or the neck 16 is removable from the handle 12, such replaceable elements will be termed "refills". In such embodiments, the processor 40 may be programmed with a plurality of algorithms in order to establish the predetermined values for a force which is (1) too high; (2) too low; (3) sufficient; (4) at a low end of a range of sufficient force and/or (5) at a high end of a range of sufficient force for a number of different refills. For example, if the high end of a range of sufficient force for a first refill is 3.00 Newtons and the high end of a range of sufficient brushing force for a second refill is 3.50 Newtons, the processor 40 may be configured to recognize the high end range value for first refill and the high end range value for the second refill. As such, the processor 40 may be programmed such that the output source 30 provides a signal to the user which corresponds to a particular refill. Some suitable examples of oral care implements which can recognize a particular refill are described in U.S. Pat. Nos. 7,086,111; 7,207,080; and 7,024,717.

The interconnectivity between the neck 16 and the handle 12 can be provided in any suitable manner. In one embodiment, shown in FIG. 4, the load member 210 may comprise a proximal portion 404 which includes a lip 420 which can allow the neck 16 and head 14 to be snap fit to the handle 12. The lip 420 may be disposed on a proximal portion 430 of the load member 210. The proximal portion 430 can be received in similarly shaped receiving region (not shown) in the neck 16.

The lip 420 may be constructed such that the lip 420 is spring loaded. In such embodiments, the lip 420 may be pushed into the proximal portion 430 thereby facilitating the attachment of the neck 16 to the proximal portion 430. In such embodiments, the lip 420 may comprise an inclined proximal surface 420A which can facilitate the attachment of the neck 16 to the proximal portion 430.

The proximal portion 430 may be integrally constructed with the load member 210. Alternatively, the proximal portion 430 may be a discrete component which is attached to the load member 210. In some embodiments, the lip 420 may be a discrete component with respect to the proximal portion 430.

The toothbrush 10 of the present invention may further comprise a timer 34. The timer 34 may be positioned inside the toothbrush 10 or may be disposed in a remote display. The timer 34 may be configured to begin automatically such as with the application of brushing force 250 (shown in FIGS. 3A and 3B). Independently, or in conjunction with the application of brushing force 250 (shown in FIGS. 3A and 3B), the timer 34 may be activated by motion of the toothbrush 10. In such embodiments, the toothbrush 10 may comprise accelerometers or other suitable device for measuring/monitoring the motion of the toothbrush 10. Such devices for monitoring/measuring the motion of the toothbrush 10 are described in U.S. Patent Application Ser. No. 61/116,327, entitled, "PERSONAL CARE SYSTEMS, PRODUCTS, AND METHODS", filed on Nov. 20, 2008. An example of a suitable timer 34 is a 555 timer integrated circuit available from many electronics stores where integrated circuits are sold.

The toothbrush 10 of the present invention may further comprise a power source 36. The power source 36 may be any suitable element which can provide power to the toothbrush 10. A suitable example includes batteries. The battery may be sized in order to minimize the amount of real estate required inside the toothbrush 10. For example, where the output source 30 consists of a light emitting element or vibratory motor (used for signaling the user and not vibrating the cleaning elements of the head and/or movement of the head) the power source 36 may be sized relatively small, e.g. smaller than a triple A battery. In such embodiments, the vibratory device may be relatively small. The battery may be rechargeable or may be disposable. Additionally, a plurality of batteries may be utilized. In some embodiments, the power source 36 may include alternating current power as provided by a utility company to a residence. Other suitable power sources are described in U.S. patent application Ser. No. 12/102,881, filed on Apr. 15, 2008, and entitled, "Personal Care Products and Methods".

In some embodiments, a user operated switch 110 (shown in FIG. 1B) may be provided which can allow the user to control when pressure indication begins as well as when the timer begins. The switch 110 (shown in FIG. 1B) may be in electrical communication with the power source 36 and the output signal element 30 and/or the timer 34.

Referring back to FIG. 1, the handle 12, the neck 16, and the head 14 may be constructed of any suitable material. Some suitable examples include polypropylene, nylon, high density polyethylene, other moldable stable polymers, the like, and/or combinations thereof. In some embodiments, the handle 12, the neck 16, and/or the head 14 may be formed from a first material and include recesses, channels, grooves, for receiving a second material which is different from the first. For example, the handle may include an elastomeric grip feature or a plurality of elastomeric grip features. The elastomers among the plurality of elastomeric grip features may be similar materials or may be different materials, e.g. color, hardness, combinations thereof or the like.

The elastomeric grip features of the handle may be utilized to overmold, at least in part, a portion of the timer 34, output signaling element 30, processor 40, and/or power source 36. In such embodiments, these components may be in electrical communication via wiring which can similarly be overmolded. The elastomeric grip features may include portions which are positioned for gripping by the palm of the user and/or portions which are positioned for gripping by the thumb and index finger of the user. These elastomeric grip features may be composed of the same material or may be different, e.g. color, shape, composition, hardness, the like, and/or combinations thereof.

The elastomeric grip features of the handle 12 may be in communication with a channel, groove, and/or recess, in the neck via an external channel, groove, recess and/or via an internal channel, groove, recess. In some embodiments, the elastomeric grip features may be in communication with a channel, groove, and/or recess in the head via an internal channel, groove, and/or recess, and/or an external channel, groove, and/or recess. Alternatively, the grip features of the handle 12 may be discrete elements from the features of the head and/or neck.

Additionally, although referred to herein as cleaning elements 20, the head 14 may comprise a variety of elements. For example, the head 14 may comprise cleaning elements and/or massaging elements. Some suitable examples of cleaning elements and/or massaging elements include bristles, abrasive elastomeric elements, elastomeric elements in a particular orientation or arrangement, e.g. pivoting fins, prophy cups, or the like. Some suitable examples of elastomeric cleaning elements and/or massaging elements are described in U.S. Patent Application Publication Nos. 2007/0251040; 2004/0154112; 2006/0272112; and in U.S. Pat. Nos. 6,553,604; 6,151,745. The cleaning elements and/or massaging elements may be tapered, notched, crimped, dimpled, or the like. Some suitable examples of these cleaning elements and/or massaging elements are described in U.S. Pat. Nos. 6,151,745; 6,058,541; 5,268,005; 5,313,909; 4,802,255; 6,018,840; 5,836,769; 5,722,106; 6,475,553; and U.S. Patent Application Publication No. 2006/0080794.

The cleaning elements and/or massaging elements may be attached to the head 14 in any suitable manner. Conventional methods include stapling, anchor free tufting, and injection mold tufting. For those cleaning/massaging elements that comprise an elastomer, these elements may be formed integral with one another, e.g. having an integral base portion and extending outward therefrom.

The head may comprise a soft tissue cleanser constructed of any suitable material. Some examples of suitable material include elastomeric materials; polypropylene, polyethylene, etc; the like, and/or combinations thereof. The soft tissue cleanser may comprise any suitable soft tissue cleansing elements. Some examples of such elements as well as configurations of soft tissues cleansers on a toothbrush are described in U.S. Patent Application Nos. 2006/0010628; 2005/0166344; 2005/0210612; 2006/0195995; 2008/0189888; 2006/0052806; 2004/0255416; 2005/0000049; 2005/0038461; 2004/0134007; 2006/0026784; 20070049956; 2008/0244849; 2005/0000043; 2007/140959; and U.S. Pat. Nos. 5,980,542; 6,402,768; and 6,102,923.

In such embodiments including a soft tissue cleanser, consumer testing, robot testing, and/or clinical testing may be performed such that an upper threshold of force and a lower threshold of force can be established to provide feedback to the user with regard to the applied force to soft tissue, e.g. tongue. For those embodiments, including a soft tissue cleanser, the toothbrush may comprise an accelerometer or other suitable device for monitoring the orientation of the toothbrush. In combination with the applied force, e.g. brushing force 250, the processor 40 can determine whether the soft tissue cleanser is being engaged or the cleaning elements are being engaged. The signal or a plurality of signals may be provided to the user as described herein. Providing feedback to the user regarding the applied force to soft tissue can assist the user in preventing damage to the soft tissue, e.g. papillae, while still achieving efficacious cleaning.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An oral hygiene implement comprising:

a handle, a head, and a neck extending between the handle and the head, the head comprising a plurality of cleaning elements and/or massaging elements attached to the head;

a force sensor; and an output source in signal communication with the force sensor; the output source providing a plurality of output signals to the user, the plurality of output signals corresponding to at least three conditions including a sufficient amount of force, a lower end of a range of sufficient force, and an upper end of the range of sufficient force.

2. The oral hygiene implement of claim 1, wherein the handle and neck are removably attachable.

3. The oral hygiene implement of claim 1, wherein the force sensor comprises a switch.

4. The oral hygiene implement of claim 3, wherein the switch is in signal communication with a processor.

5. The oral hygiene implement of claim 4, wherein the processor is in signal communication with the output source.

6. The oral hygiene implement of claim 4, wherein the force sensor comprises a load member having a compliant element, wherein the load member is movably coupled to the handle.

7. The oral hygiene implement of claim 6, wherein the load member is pivotally mounted within the handle, wherein the load member comprises a distal portion and a proximal portion, and wherein the proximal portion extends out of the handle and engages a portion of the neck.

8. The oral hygiene implement of claim 7, wherein the compliant element comprises a spring disposed within the handle.

9. The oral hygiene implement of claim 6, wherein the head and/or neck apply a force on the load member in a first direction and wherein the compliant element applies a force on the load member in a second direction.

10. The oral hygiene implement of claim 6, wherein the head and/or neck apply a force on the load member in a first direction and wherein the compliant element applies a force on a lever in the first direction.

11. The oral hygiene implement of claim 10, wherein the head and/or neck apply a force on the load member thereby creating a first moment about a pivot, and wherein the compliant element applies a force on the load member thereby creating a second moment about the pivot, the first moment and the second moment being in opposite directions.

12. The oral hygiene implement of claim 1, wherein the force sensor comprises a plurality of switches, wherein the plurality of switches comprise a first switch and a second switch, wherein the first switch is associated with a first output signal and the second switch is associated with a second output signal.

13. The oral hygiene implement of claim 12, wherein the first output signal is different from the second output signal.

14. The oral hygiene implement of claim 1, further comprising a timer.

15. The oral hygiene implement of claim 14, wherein the timer and the force sensor are in signal communication with a microprocessor.

16. The oral hygiene implement of claim 1, wherein the output signals are provided to the user on an external display.

17. The oral hygiene implement of claim 1, wherein the head and neck are releasably attached to the handle.

18. An oral care implement comprising:

a handle, a head, and a neck extending between the handle and the head, the head comprising a plurality of cleaning elements and/or massaging elements;

a force sensor having a load member, a compliant element, a switch, and an output source, wherein the load member is pivotably disposed, at least in part, within the handle, wherein the compliant element provides a force on the load member thereby inducing a moment in a first direction about a pivot point, wherein an applied brushing force induces a moment in a second direction about the pivot point, the second direction being different from the first direction, wherein the switch is in signal communication with the output source, wherein the output source is configured to provide a plurality of output signals to a user, the plurality of output signals corresponding to at least three conditions including a sufficient amount of force, a lower end of a range of sufficient force, and an upper end of a range of sufficient force.

19. The oral care implement of claim 18, further comprising a processor in signal communication with the force sensor.

20. The oral care implement of claim 19, wherein the processor is configured to filter the input from the force sensor.

21. An oral care implement comprising:

a handle, a head, and a neck extending between the handle and the head, the head comprising a plurality of cleaning elements and/or massaging elements attached to the head;

a force sensor; and an output source in signal communication with the force sensor; the output source providing a first output signal and a second output signal, wherein the first output signal corresponds to a lower end of a range of sufficient force, and wherein the second output signal corresponds to an upper end of the range of sufficient force, the output source being configured to provide an output signal corresponding to a sufficient amount of force.

* * * * *